US012114753B2

(12) United States Patent
Sanchez

(10) Patent No.: US 12,114,753 B2
(45) Date of Patent: Oct. 15, 2024

(54) COSMETIC APPLICATOR HAVING A CAVITY SUPPORTED BY SUPPORT ARMS

(71) Applicant: L'OREAL, Paris (FR)

(72) Inventor: Marcel Sanchez, Clichy (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 18/001,493

(22) PCT Filed: Jun. 11, 2021

(86) PCT No.: PCT/EP2021/065845
§ 371 (c)(1),
(2) Date: Dec. 12, 2022

(87) PCT Pub. No.: WO2021/259680
PCT Pub. Date: Dec. 30, 2021

(65) Prior Publication Data

US 2023/0240429 A1 Aug. 3, 2023

(30) Foreign Application Priority Data

Jun. 26, 2020 (FR) ..... 20 06724

(51) Int. Cl.
*A46B 11/00* (2006.01)
*A45D 34/04* (2006.01)
*A45D 40/26* (2006.01)

(52) U.S. Cl.
CPC ..... *A45D 34/04* (2013.01); *A45D 34/045* (2013.01); *A45D 40/26* (2013.01); *A45D 40/265* (2013.01); *A45D 2200/1018* (2013.01); *A46B 2200/1046* (2013.01); *A46B 2200/1053* (2013.01); *A46B 2200/106* (2013.01)

(58) Field of Classification Search
CPC .... A46B 2200/1046; A46B 2200/1053; A46B 2200/106; A45D 40/26; A45D 40/265; A45D 34/04; A45D 34/045
USPC ..... 401/119, 126, 130
See application file for complete search history.

(56) References Cited

U.S. PATENT DOCUMENTS

| | | | | |
|---|---|---|---|---|
| 7,918,619 | B2 * | 4/2011 | Gueret | A45D 40/262 401/128 |
| 10,010,151 | B2 * | 7/2018 | Gueret | A45D 34/045 |
| 11,044,981 | B2 * | 6/2021 | Cabon | A45D 40/262 |
| 11,064,798 | B2 * | 7/2021 | Sanchez | A45D 40/267 |

(Continued)

FOREIGN PATENT DOCUMENTS

| | | |
|---|---|---|
| FR | 2 951 920 A1 | 5/2011 |
| FR | 3 060 272 A1 | 6/2018 |

OTHER PUBLICATIONS

International Search Report issued Jul. 5, 2021, in PCT/EP2021/065845, filed on Jun. 11, 2021, 3 pages.

*Primary Examiner* — Jennifer C Chiang
(74) *Attorney, Agent, or Firm* — Christensen O'Connor Johnson Kindness PLLC

(57) ABSTRACT

A cosmetic device having a longitudinal axis, includes an applicator having an applicator part including at least one main interior cavity delimited laterally by a first lateral portion and a second lateral portion and axially by a distal portion and a proximal portion that are elongate along respective longitudinal axes that extend parallel to a plane that makes a nonzero angle with the axis of an end piece, and a main arm of longitudinal axis connects an outer edge of the proximal portion to the fastening end piece.

11 Claims, 5 Drawing Sheets

(56) References Cited

U.S. PATENT DOCUMENTS

| | | | |
|---|---|---|---|
| 2007/0020027 | A1 | 1/2007 | Gueret |
| 2012/0312315 | A1 | 12/2012 | Gueret |

* cited by examiner

[Fig. 1]
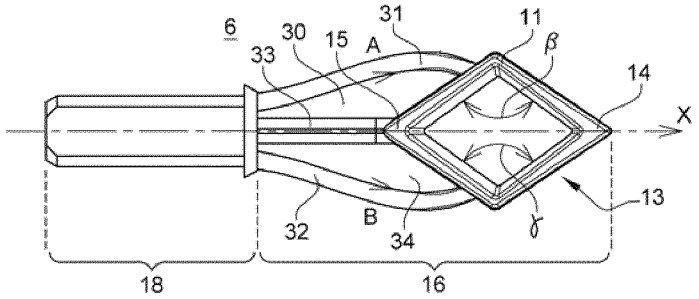
[Fig. 2]
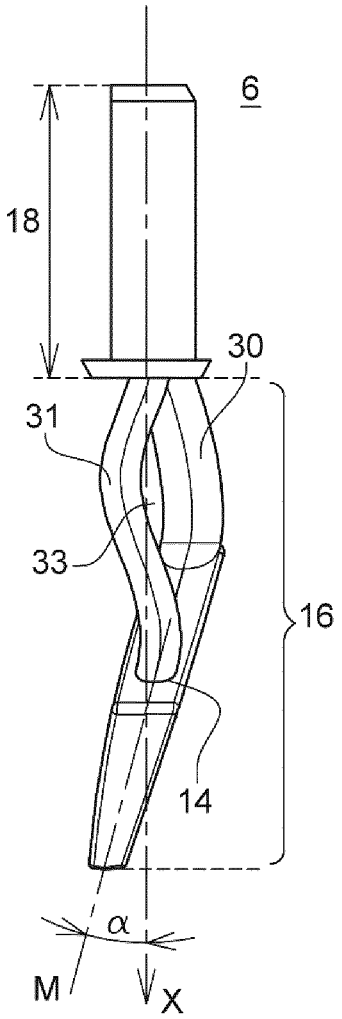

[Fig. 3]
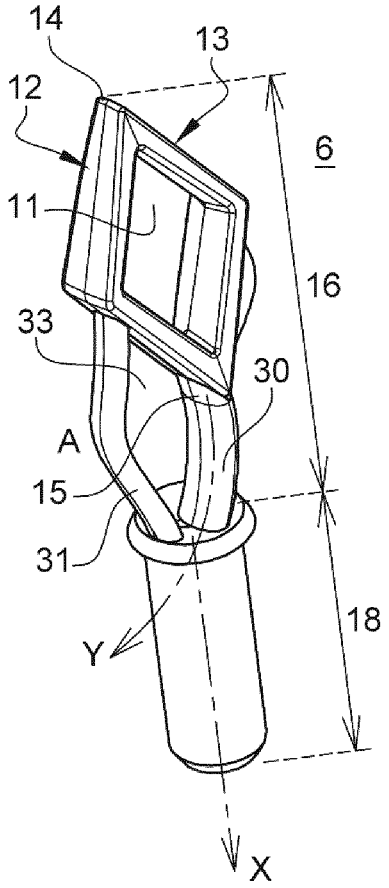

[Fig. 4]
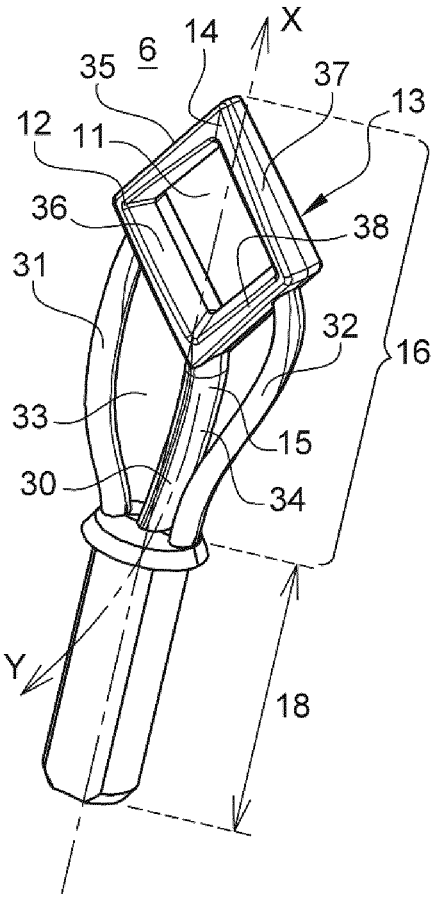

[Fig. 5]
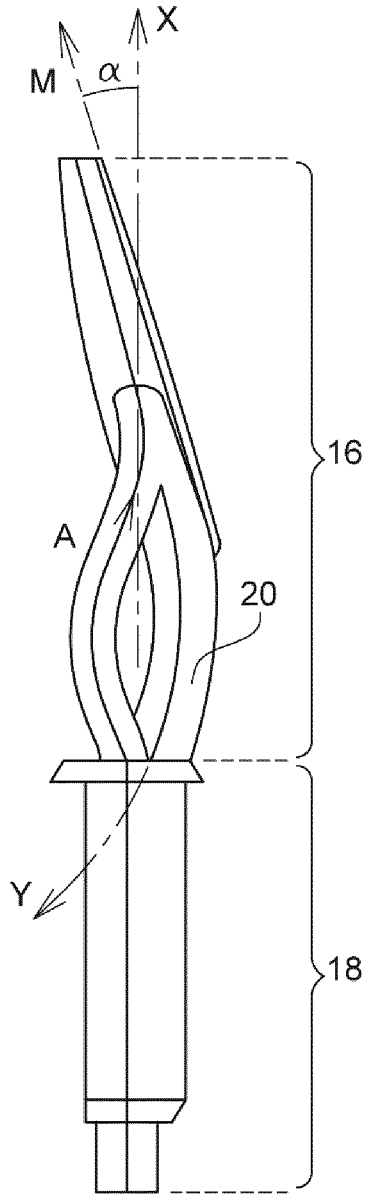

[Fig. 6]
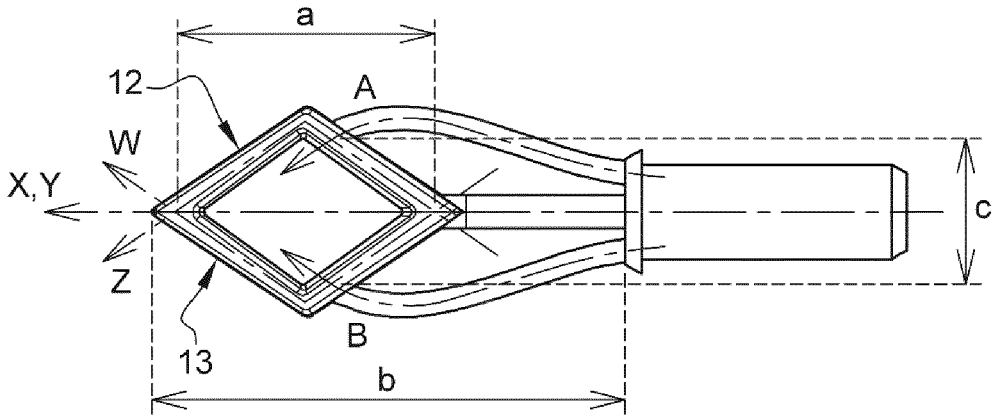

COSMETIC APPLICATOR HAVING A CAVITY SUPPORTED BY SUPPORT ARMS

The present invention relates to devices for packaging and application of a cosmetic or care product. This may be for example a makeup or care product, for example a lipstick, a lip gloss, a concealer, a foundation, an eyeshadow.

More generally, a cosmetic product is a product as defined in Regulation (EC) No 1223/2009 of the European Parliament and Council of 30 Nov. 2009 relating to cosmetic products.

TECHNOLOGICAL BACKGROUND

The European patent EP 0 792 602-B1 discloses a product applicator having a flexible support forming an applicator part, covered at least partially with at least one layer of a spongy material. Such an applicator is used differently than conventional applicators which have an applicator member disposed at the end of a stem and in which the applicator member is loaded with product by being dipped in a container optionally provided with a wiping member.

The patent U.S. Pat. No. 6,120,202 discloses a device for simultaneously producing two decorative patterns on the nails, having an applicator which has two stems that are each provided at one end with an applicator member provided with a circular cutout.

The European patent application EP 0 875 169-A1 discloses an applicator having an applicator member that has a flocked foam block at one end. The lateral surface of the applicator member is striated.

The European patent EP 0 824 329-B1 describes a packaging and application device having a wiping member made up at least partially of a cellular material. In one exemplary embodiment, the applicator member is in the form of a hollow body having a cavity that is able to accommodate a reserve of product.

The French patent application FR 2 771 077 likewise describes a packaging and application device having a wiping member made up at least partially of an elastically deformable porous material. In one exemplary embodiment, the applicator member has slots that are sufficiently narrow for it to be difficult for the wiping member to reach them, making it possible to keep a reserve of product inside the applicator member after wiping.

Furthermore, the European patent EP 1 053 695-B1 discloses an applicator having an applicator member that can deform on passing the wiping member. The application surface is relatively narrow and the comfort during application is not entirely satisfactory.

The European patent application EP 0 693 263-A1 discloses an applicator having a stem at the end of which there is disposed an applicator member made up of a loop, the two ends of which are connected separately to the stem. Such an applicator is more particularly intended for the application of nail varnish and the stem exhibits flexibility similar to that of the applicator member.

The patent application US 2002/0005209 discloses an applicator for applying a product to the eyelashes or eyebrows, having arms that are joined together at their ends and bear protruding elements that may be flocked.

The patent U.S. Pat. No. 4,974,980 discloses an application element, the cross section of which is inscribed in that of the stem when the applicator is viewed along the longitudinal axis of the stem. In other words, the application element does not protrude laterally beyond the stem.

The patent application FR3066683 discloses an application element having an interior cavity of closed contour and a lateral notch.

The application WO201891819 describes an application element having two lateral arms and one central arm, the two lateral arms defining a cavity. The central arm has a widened portion and a narrowed portion.

The present invention aims to propose a novel applicator for applying makeup with care, which is comfortable to use, and is capable of storing a relatively large amount of product.

DEFINITION OF THE INVENTION

The invention relates to a cosmetic device of longitudinal axis X for packaging and application, comprising: —an applicator having a stem bearing an at least partially elastically deformable application element and having an applicator part comprising at least one main interior cavity delimited laterally by a first lateral portion and a second lateral portion and axially by a distal portion and a proximal portion that join the first lateral portion and the second lateral portion together, the application element being provided with a fastening end piece of longitudinal axis X fitted in the stem, —a container containing a product to be applied, in which the application element can be accommodated when not in use, the container having an opening through which the application element can pass when the latter is withdrawn from the container, the first lateral portion and the second lateral portion being elongate along respective longitudinal axes that extend parallel to a plane that makes a nonzero angle with the axis X of the end piece, and a main arm of longitudinal axis connecting an outer edge of the proximal portion to the fastening end piece, the main interior cavity having, in at least one plane, a closed contour.

The applicator of the device according to the invention has an application zone shifted into a main cavity at a distance from the end piece and the stem. The hand actions are different than those of conventional applicators, because the product zone is supported by a main arm that separates the main cavity and the end piece for greater flexibility of the applicator during makeup application. The formulation is metered by inclining the cavity with respect to the axis of the end piece, thereby increasing the accuracy of makeup application.

MAIN DEFINITIONS

A "cross section of a component of axis X" is a section perpendicular to the axis X of the component.

The "longitudinal axis of a component" denotes the line connecting all of the centers of mass of the cross sections of a component.

PREFERRED EMBODIMENTS

Preferably, the application element according to the invention has one or more of the following features, taken alone or in combination:

It has a first supporting arm of longitudinal axis A and a second supporting arm of longitudinal axis B, which are situated on either side of the main arm, the first supporting arm connecting a first outer edge of a first lateral portion to the fastening end piece and the second supporting arm connecting a second outer edge of a second lateral portion to the fastening end piece. The supporting arms give the applicator flexibility for better makeup application.

The main arm defines, with the first supporting arm and a part of the first lateral portion, a first interior cavity and the main arm defines, with the second supporting arm and a part of the second lateral portion, a second interior cavity. The first and the second interior cavity can store makeup product while keeping the main interior cavity in its displaced position.

At least one of the first supporting arm and the second supporting arm has a dimension, in cross section perpendicularly to the longitudinal axis A of the first supporting arm or perpendicularly to the longitudinal axis B of the second supporting arm, respectively, that is smaller than a dimension of the main arm in cross section perpendicularly to the axis Y, the dimension being in particular a width or a height. These dimensions improve the flexibility of the applicator.

The application element has a symmetric shape relative to a median plane, in particular a median plane containing the longitudinal axis of the stem to which the application element is connected. Makeup application is intuitive and easier.

The main interior cavity is a through-cavity. It is easier for the user to pick up and spread the product. This is because the main interior cavity opens onto two opposite faces of the application element, at least one of which is used to apply the product.

The first lateral portion has a first segment and a second segment that preferably form a first obtuse angle β between one another, and the second lateral portion has a third segment and a fourth segment that preferably form a second obtuse angle γ between one another. The user can easily make use of the edge face of the applicator to spread the product.

The application element is molded in one piece. This manufacturing method is quick and reliable.

As seen from above perpendicularly to the longitudinal axis Y of the main arm, the main interior cavity extends internally along less than half the length of the applicator part.

The interior width of the main interior cavity is greater than the width of the joined-together first lateral portion and second lateral portion. The applicator is thin for precise application of the product.

The product is intended for making up the mucous membranes, the skin or the nails.

DESCRIPTION OF THE FIGURES

Further features and advantages of the invention will become apparent from reading the following detailed description of nonlimiting implementation examples thereof and from examining the appended, schematic and partial, drawing, in which:

FIG. 1 is a top view of a flocked application element according to the invention, FIG. 2 is a side view of the applicator in FIG. 1, FIG. 3 is an inclined perspective view from one side of the longitudinal axis of the applicator in FIG. 1, FIG. 4 is an inclined perspective view from the other side of the longitudinal axis of the applicator in FIG. 1, FIG. 5 is a perspective view of the applicator in FIG. 1, FIG. 6 is a top view of the applicator in FIG. 1 without flocking.

The packaging and application device according to the invention has, for example, a container containing a product P to be applied, and an applicator having a stem, provided at a first end with a gripping member that also constitutes a cap for closing the container in a sealed manner, and at the other end with an application element 6 of longitudinal axis X having a rear face 20.

The container is provided in its upper part with a neck in which a wiping member is fitted.

The gripping member is screwed onto the neck but could, as an alternative, be attached in some other way, for example by snap-fastening.

In the example in FIG. 1, the outer surface of the application element 6 is flocked, but the invention is not limited to one particular surface covering and the application element 6 may for example not be flocked or have at least partially on its surface a covering other than flocking, for example a woven fabric, a nonwoven fabric, a foam, or exhibit reliefs, for example a grid pattern.

In the example illustrated, the application element 6, as can be seen in FIG. 1, has a symmetric overall shape with respect to a median plane of symmetry M and has an end piece 18 and an applicator part 16.

The applicator part 16 is provided with a main interior cavity 11 delimited laterally by a first lateral portion 12 and a second lateral portion 13 and axially by a distal portion 14 and a proximal portion 15 that join the first lateral portion 12 and the second lateral portion 13 together.

The applicator part 16 is provided with a main arm 30 of longitudinal axis Y, which is curved in FIGS. 3 to 5, although the longitudinal axis Y could also be straight. The main arm 30 connects the end piece 18 of longitudinal axis X to the main interior cavity 11. It preferably has a tapered shape, so as to increase the flexibility of the applicator.

The first lateral portion 12 and the second lateral portion 13 are elongate along respective longitudinal axes Z and W (FIG. 6) which extend substantially parallel to a plane M, as can be seen in FIG. 2 and FIG. 5, that makes an angle α of for example between 5° and 60°, preferably between 10° and 40°, and more preferably between 20° and 30°, with the axis X of the end piece 18.

The first lateral portion 12 has a first segment 35 and a second segment 36 that form a first angle β, equal to about 120° in the figures, between one another. The second lateral portion 13 has a third segment 37 and a fourth segment 38 that form a second angle γ, symmetric with the angle with respect to the longitudinal axis of the interior cavity 11, between one another.

The shape of the distal portion 14 and proximal portion 15 will advantageously be chosen so as to make it easier to pass through the opening of the container.

In the example in question, the lateral portions 12, 13 converge toward one another in the direction of the distal portion 14 and the cavity 11, when the application element 6 is viewed in elevation, has substantially a rhombus shape.

The cavity 11 extends for example internally along a length a, as can be seen in FIG. 6, in particular along less than half the length b of the applicator part 16.

The dimensions of the cavity 11 can be chosen depending on the deformability necessary for passing through the opening of the container and on the amount of product that is intended to be optionally retained, in particular by capillary action, in the cavity 11 after the applicator has been withdrawn from the container.

In FIG. 6, it is apparent that the width b of the application element 6 is greater than the smallest diameter of the wiping member (not shown), such that the application element 6 deforms on passing through the latter. The interior width c of the main interior cavity 11 is greater than the width of the joined-together first lateral portion 1 and second lateral portion 13.

The product P present in the cavity 11 increases the autonomy of the applicator and can also improve the comfort during application, by making it easier to slide the applicator over the surface treated.

The product P is intended for example to be applied to the lips and the user can deposit it thereon for example by bringing the rear face 20 of the application element 6 into contact therewith. In the example in question, the rear face 20 corresponds to the face that is situated on the rear side when the application element 6 is viewed with the lateral portions 12, 13 extending toward the front.

During application, depending on the surface of the application element 6 in contact with the zone treated, the thickness of product deposited could be different, and this may allow the user to vary for example the gloss of the makeup.

When the application element 6 is applied flat, the product P present in the cavity 11 can be deposited and the surface loaded with product P that comes into contact with the lips can be relatively large, such that the lips can be made up fairly quickly.

If need be, the application can be carried out just with the end of the distal portion 15, in order to define a contour for example.

The application element 6 can be fastened to the stem 4 in various ways.

The stem and the application element can be made of plastics material, chosen for example from polypropylenes, polyethylenes, polyamides, acetal resins, polyesters, resins based on polyesters and thermoplastic elastomers (TPE). They may be entirely flexible, being made for example from an elastomer, for example EPDM, silicone or latex, this list not being limiting.

The end piece 18 is for example adhesively bonded, clipped or welded in the stem. The latter may also be crimped to the end piece.

The main cavity 11 is connected to the end piece 18 by the main arm 30 and by two supporting arms, a first supporting arm 31 of longitudinal axis A and a second supporting arm 32 of longitudinal axis B, which are situated on either side of the main arm 30. The cross section of the supporting arms perpendicularly to their longitudinal axes A and B is smaller than the cross section of the main arm 30, in order to give the supporting arms a degree of flexibility which promotes makeup application by encouraging the applicator part 16 to pivot.

The main arm 30 defines, with the first supporting arm 31 and a part of the first lateral portion 12, a first interior cavity 33 and the main arm 30 defines, with the second supporting arm 32 and a part of the second lateral portion 13, a second interior cavity 34.

The application element can be molded in one piece, produced by injection-molding, two-shot injection-molding, and optionally flocked.

The invention is not limited to the embodiments described. For example, the cavity may have any other shape or the supporting arms could be positioned differently.

The invention claimed is:

1. A cosmetic device of longitudinal axis for packaging and application, comprising:

an applicator having a stem bearing an at least partially elastically deformable application element and having an applicator part comprising at least one main interior cavity delimited laterally by a first lateral portion and a second lateral portion and axially by a distal portion and a proximal portion that join the first lateral portion and the second lateral portion together, the application element being provided with a fastening end piece of longitudinal axis X fitted in the stem, a container containing a product to be applied, in which the application element can be accommodated when not in use, the container having an opening through which the application element can pass when the latter is withdrawn from the container, wherein the first lateral portion and the second lateral portion are elongate along respective longitudinal axes that extend parallel to a plane that makes a nonzero angle with the axis of the end piece, and a main arm of longitudinal axis connects an outer edge of the proximal portion to the fastening end piece, the main interior cavity having, in at least one plane, a closed contour.

2. The device as claimed in claim 1, wherein it has a first supporting arm of longitudinal axis and a second supporting arm of longitudinal axis, which are situated on either side of the main arm, the first supporting arm connecting a first outer edge of a first lateral portion to the fastening end piece and the second supporting arm connecting a second outer edge of a second lateral portion to the fastening end piece.

3. The device as claimed in claim 2, wherein the main arm defines, with the first supporting arm and a part of the first lateral portion, a first interior cavity and the main arm defines, with the second supporting arm and a part of the second lateral portion, a second interior cavity.

4. The device as claimed in claim 2, wherein at least one of the first supporting arm and the second supporting arm has a dimension, in cross section perpendicularly to the longitudinal axis of the first supporting arm or perpendicularly to the longitudinal axis of the second supporting arm, respectively, that is smaller than a dimension of the main arm in cross section perpendicularly to the axis, the dimension being in particular a width or a height.

5. The device as claimed in claim 1, wherein the application element has a symmetric shape relative to a median plane, in particular a median plane containing the longitudinal axis of the stem to which the application element is connected.

6. The device as claimed in claim 1, wherein the main interior cavity is a through-cavity.

7. The device as claimed in claim 1, wherein the first lateral portion has a first segment and a second segment that preferably form a first obtuse angle between one another, and the second lateral portion has a third segment and a fourth segment that preferably form a second obtuse angle between one another.

8. The device as claimed in claim 1, wherein the application element is molded in one piece.

9. The device as claimed in claim 1, wherein as seen from above perpendicularly to the longitudinal axis of the main arm, the main interior cavity extends internally along less than half the length of the applicator part.

10. The device as claimed in claim 1, wherein the interior width of the main interior cavity is greater than the width of the joined-together first lateral portion and second lateral portion.

11. The device as claimed in claim 1, wherein the product is intended for making up the mucous membranes, the skin or the nails.

* * * * *